US007322661B1

(12) United States Patent
Salvesen

(10) Patent No.: US 7,322,661 B1
(45) Date of Patent: Jan. 29, 2008

(54) STORAGE CABINET

(75) Inventor: William R. Salvesen, North Bergen, NJ (US)

(73) Assignee: Karen Salvesen, East Rockaway, NY (US)

( * ) Notice: Subject to any disclaimer, the term of this patent is extended or adjusted under 35 U.S.C. 154(b) by 0 days.

(21) Appl. No.: 11/623,365

(22) Filed: Jan. 16, 2007

(51) Int. Cl.
*A47B 96/00* (2006.01)

(52) U.S. Cl. ..... 312/322; 312/324; 312/298; 292/146; 292/302

(58) Field of Classification Search ..... 312/324, 312/322, 297, 109, 110, 298; 160/206, 214; 49/213, 260, 257, 258, 366, 372, 125, 127; 220/815, 813; 292/290, 295, 109, 116, 114, 292/102, 106, 146, 150, 300, 302, DIG. 11, 292/DIG. 53, DIG. 64, DIG. 68; 70/54–56, 70/DIG. 64, DIG. 65, DIG. 66; 109/69, 109/70

See application file for complete search history.

(56) References Cited

U.S. PATENT DOCUMENTS

| | | | | | |
|---|---|---|---|---|---|
| 993,329 | A * | 5/1911 | Trow | 217/56 |
| 1,811,313 | A * | 6/1931 | Fildes | 220/1.5 |
| 3,321,258 | A * | 5/1967 | Mackay | 312/287 |
| 3,398,485 | A * | 8/1968 | Stokes | 49/202 |
| 3,715,998 | A * | 2/1973 | Teleky | 109/58 |
| 3,907,021 | A * | 9/1975 | Smith | 160/118 |
| 4,146,278 | A * | 3/1979 | Seitel | 312/35 |
| 4,279,454 | A * | 7/1981 | Koiso et al. | 312/297 |
| 4,431,044 | A * | 2/1984 | Bruneau | 160/117 |
| 4,945,972 | A * | 8/1990 | Takeuchi | 160/203 |
| 5,083,847 | A * | 1/1992 | Peters | 312/322 |
| 5,131,449 | A * | 7/1992 | Winn et al. | 160/199 |
| 5,302,013 | A * | 4/1994 | Reiner | 312/249.11 |
| 6,056,376 | A * | 5/2000 | Yenglin et al. | 312/139.1 |

* cited by examiner

*Primary Examiner*—Janet M. Wilkens
*Assistant Examiner*—Mart K Kuhn
(74) *Attorney, Agent, or Firm*—Arthur Jacob

(57) ABSTRACT

A storage cabinet provides for the secure storage of items against unauthorized access, with ready authorized access The cabinet has an opening extending laterally across the front of the cabinet, and a door having panels carrying latches, the panels being movable laterally between a latched position and an unlatched position, and being pivotally mounted for movement between a lateral orientation, wherein the panels close the opening, and a transverse orientation, wherein the panels allow access to the items stored in the cabinet. A locking arrangement selectively locks the panels in place when latched in position closing the opening, for preventing unauthorized access. When unlatched, the panels can be pivoted to open access through the opening, and can be folded and moved in transverse directions into the cabinet so as to maintain a compact, unobstructed configuration when the cabinet is open.

17 Claims, 6 Drawing Sheets

FIG. 2
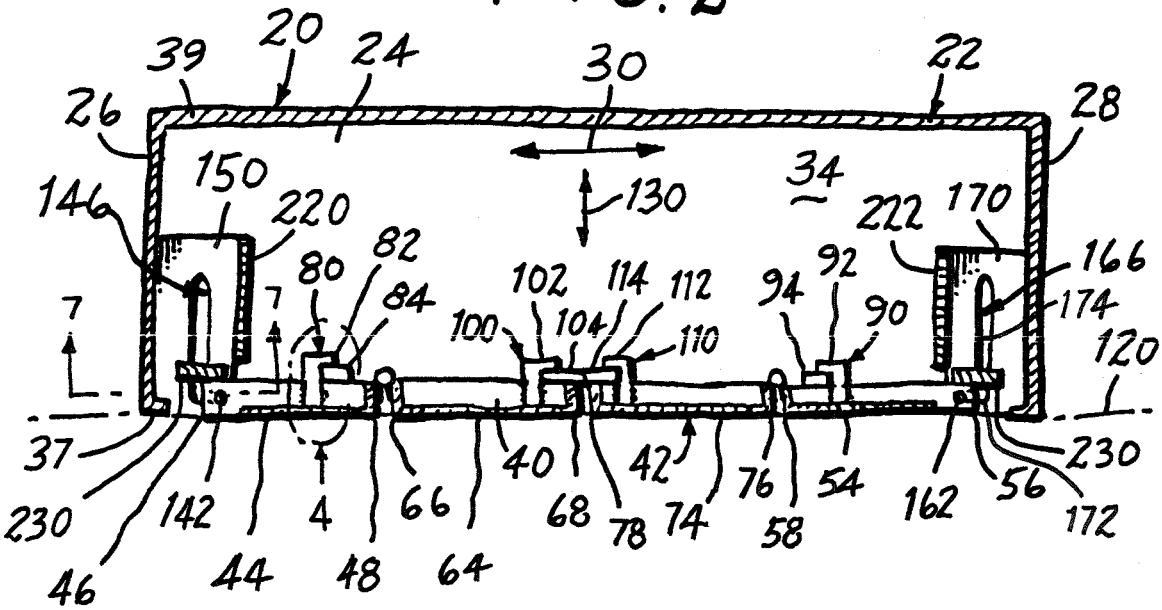
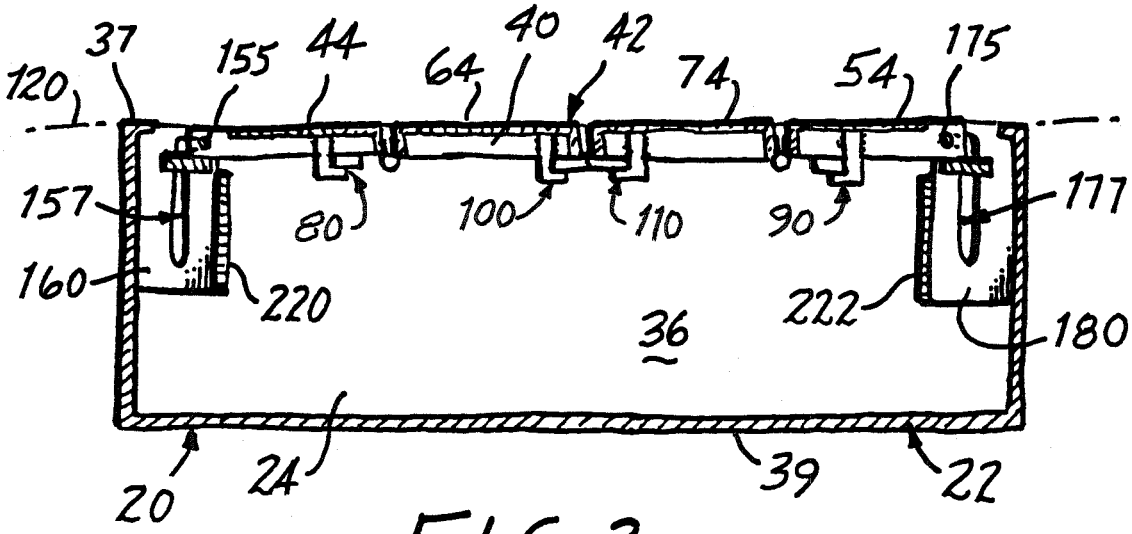
FIG. 3

STORAGE CABINET

The present invention relates generally to storage cabinets and pertains, more specifically, to a storage cabinet which provides an unobstructed storage space having a high degree of security, with an ease of selective, authorized access.

A myriad of storage cabinets currently are available for the storage of a very wide variety of items, each storage cabinet being provided with structural features and characteristics tailored to the needs of the particular items being stored.

The present invention is directed to a storage cabinet which provides a high degree of security for items that must be restricted to only authorized access, and which accomplishes that end with a compact, relatively economical construction that enables efficient storage with ease of authorized access to the stored items. As such, the present invention attains several objects and advantages, some of which are summarized as follows: Provides a storage cabinet offering a high degree of security for stored items, with ease of authorized access to the stored items; maintains an unobstructed, effective storage space for efficient storage of items which require restricted access; features a compact construction requiring only minimal installation space for maximum storage capacity and enabling ease of placement in a wide variety of locations; enables simple and ready operation for authorized use; provides a rugged construction, economically manufactured for exemplary performance over a long service life.

The above objects and advantages, as well as further objects and advantages, are attained by the present invention which may be described briefly as a storage cabinet for providing secure storage with ready authorized access to stored items, the storage cabinet comprising: a case providing an interior storage space, the case including first and second sides spaced apart laterally, extending altitudinally between a base and a top, and extending transversely between a front and a back to bound the interior storage space; an opening at the front of the case for enabling access to the interior storage space; a door having at least a first panel extending altitudinally between the base and the top of the case, the first panel having a near edge juxtaposed with the first side of the case; a coupling arrangement coupling the first panel of the door with the case for selective pivotal movement about a first pivotal axis extending altitudinally along the first panel, adjacent the near edge, between a first orientation wherein the panel extends in a lateral direction along the front of the case, between the first and second sides of the case, and a second orientation wherein the first panel extends in a transverse direction outwardly from the interior storage space; and a latching arrangement for securing the door in place across the opening, the latching arrangement including complementary latching members carried by the case and the door for selective engagement and disengagement in response to corresponding movements of the door in lateral directions relative to the case between a latched location and an unlatched location; the coupling arrangement further being configured for enabling lateral translation of the first pivotal axis for selective movement of the first pivotal axis and the first panel along a first path of travel extending laterally across the front of the case to move the door between the latched location and the unlatched location when the panel is in the first orientation and for transverse translation of the first pivotal axis for selective retraction and advancement of the first pivotal axis and the first panel along a second path of travel extending adjacent the first side, between the front and the back of the case, when the panel is in the second orientation.

The invention will be understood more fully, while still further objects and advantages will become apparent, in the following detailed description of a preferred embodiment of the invention illustrated in the accompanying drawing, in which:

FIG. 2 is a somewhat diagrammatic cross-sectional view taken along line 2-2 of FIG. 1;

FIG. 3 is a somewhat diagrammatic cross-sectional view taken along line 3-3 of FIG. 1;

Figure 1:
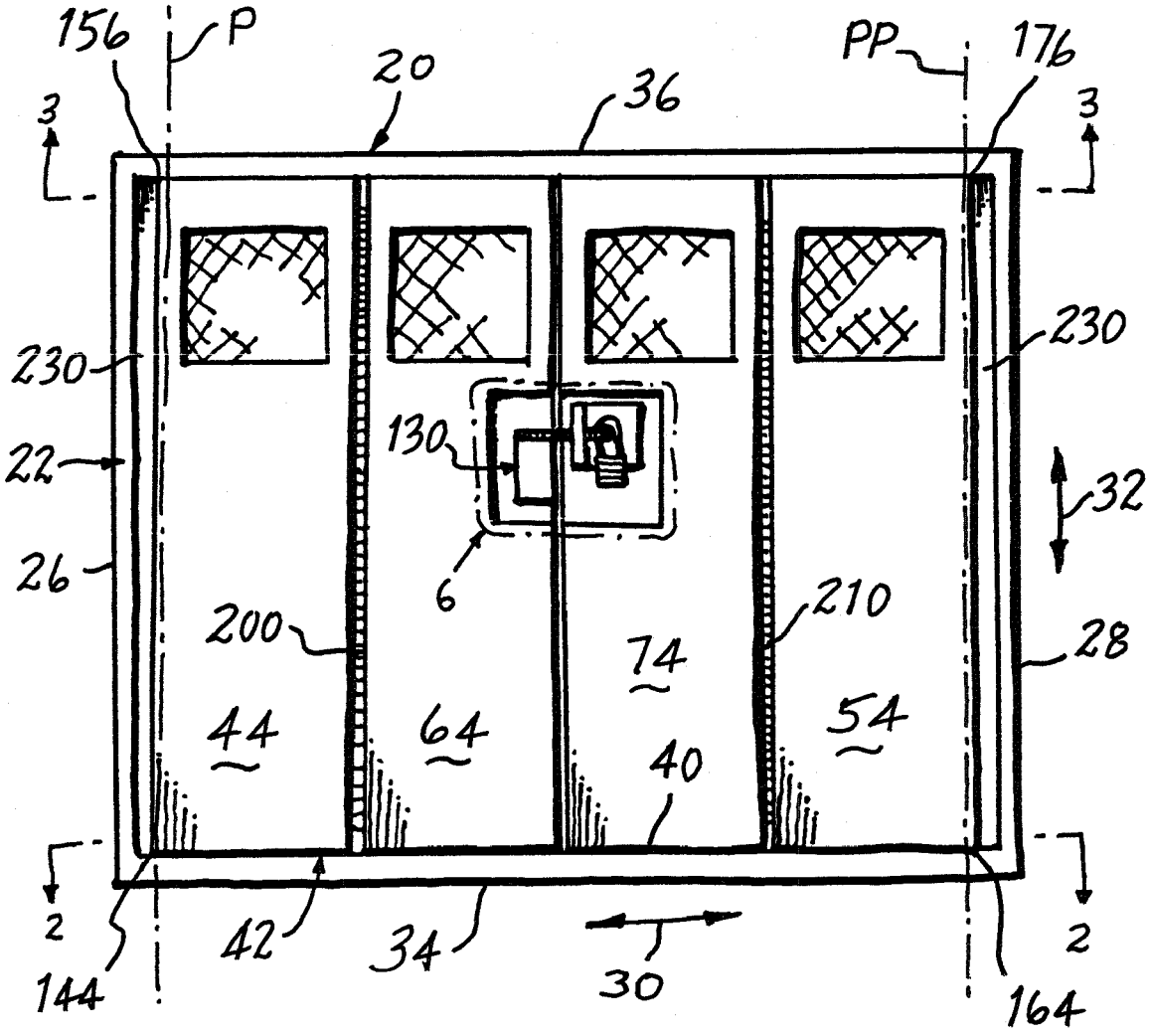
FIG. 1 is a front elevational view of a storage cabinet constructed in accordance with the present invention.

Referring now to the drawing, and especially to FIGS. 1 through 3 thereof, a storage cabinet constructed in accordance with the present invention is shown at 20 and is seen to include a case 22 providing an interior storage space 24. Case 22 includes a first side in the form of side panel 26 and a second side in the form of side panel 28, the side panels 26 and 28 being spaced from one another in lateral directions 30. Side panels 26 and 28 extend in an altitudinal direction 32, between a base shown in the form of a lower basal member 34 and a top shown in the form of an upper top member 36. The side panels 26 and 28, the basal member 34 and the top member 36 all extend in transverse directions 38 between the front 37 of the case 22 and a back panel 39, thus bounding the interior storage space 24.

An opening 40 at the front 37 of the case 22 enables access to the interior storage space 24, and a door 42 selectively closes and opens access to the interior storage space 24 through opening 40, the door 42 being shown in FIGS. 1 through 3 in a closed and locked position wherein unauthorized access to interior storage space 24 is precluded. Door 42 is comprised of four panels, as follows: A first door panel 44 extends altitudinally from the basal member 34 to the top member 36 and includes a near edge 46 juxtaposed with the side panel 26, and a far edge 48 spaced laterally from the near edge 46. A second door panel 54 extends altitudinally from the basal member 34 to the top member 36 and includes a near edge 56 juxtaposed with the side panel 28, and a far edge 58 spaced laterally from the near edge 56. A further door panel 64 extends altitudinally from the basal member 34 to the top member 36 and includes a near edge 66 juxtaposed with the far edge 48 of the first door panel 44, and a far edge 68 spaced laterally from the near edge 66. Similarly, a still further door panel 74 extends altitudinally from the basal member 34 to the top member 36 and includes a near edge 76 juxtaposed with the far edge 58 of the second door panel 54, and a far edge 78 spaced laterally from the near edge 76. Each door panel 44, 54, 64 and 74, the basal member 34, the top member 36 and the back panel 39 preferably are constructed of steel.

Figure 4:
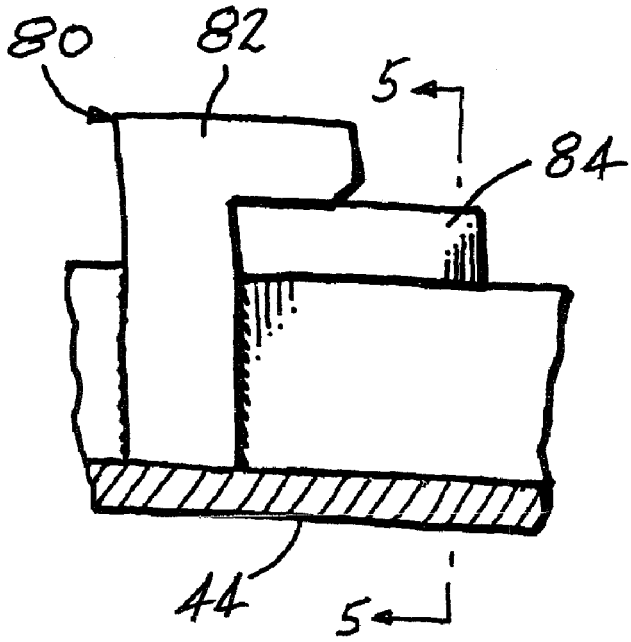
FIG. 4 is an enlarged, fragmentary view of a portion of the cabinet, indicated at 4 in FIG. 2.
Figure 5:
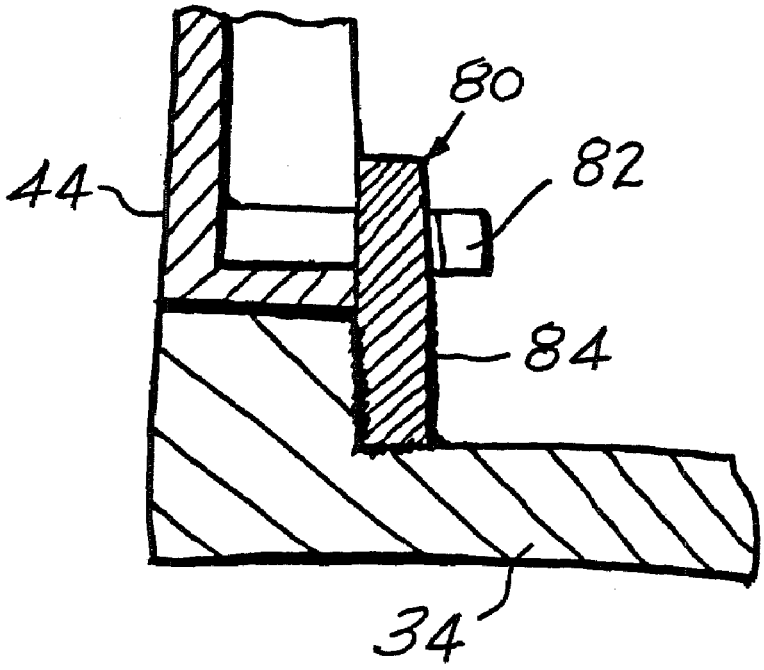
FIG. 5 is a cross-sectional view taken along line 5-5 of FIG. 4.

Door 42 closes opening 20 and provides a high degree of security against unauthorized access to items stored within the interior storage space 24, while enabling ease of authorized access to the interior storage space 24. As best seen in FIGS. 4 and 5, as well as in FIGS. 2 and 3, a latching arrangement secures the door 42 in place over the opening 40, the latching arrangement including complementary latching members carried by the case 22 and the door 42, shown in the form of latches, as follows: first latches 80 each include a latch bar 82 affixed to the first door panel 44, as by welding, adjacent the basal member 34, and adjacent the top member 36, and a complementary strike plate 84 affixed to each of the basal member 34 and the top member 36, as by welding, in position to be engaged by a corresponding latch bar 82 when the door 42 is closed, as shown in FIGS. 2 through 5. Such engagement of each latch bar 82 with a counterpart strike plate 84 secures the first panel 44 against movement in a transverse direction, thereby precluding movement of the first panel 44 into or away from interior storage space 24.

In a similar manner, second latches 90 include complementary latch bars 92 and strike plates 94 affixed to the second door panel 54 and to basal member 34 and top member 36 for engagement to secure the second panel 54 against movement in a transverse direction, thereby precluding movement of the second panel 54 into or away from interior storage space 24. Likewise, third latches 100 include latch bars 102 affixed to the further door panel 64 and complementary strike plates 104 affixed to basal member 34 and top member 36 for engagement to secure the further door panel 64 in place, and fourth latches 110 include latch bars 112 affixed to the still further door panel 74 and complementary strike plates 114 affixed to basal member 34 and top member 36 for engagement to secure the still further door panel 74 in place. Thus, when the door 42 is closed, all four door panels 44, 54, 64 and 74 are placed in a common lateral plane 120 and are secured in place against transverse movements.

Figure 6:
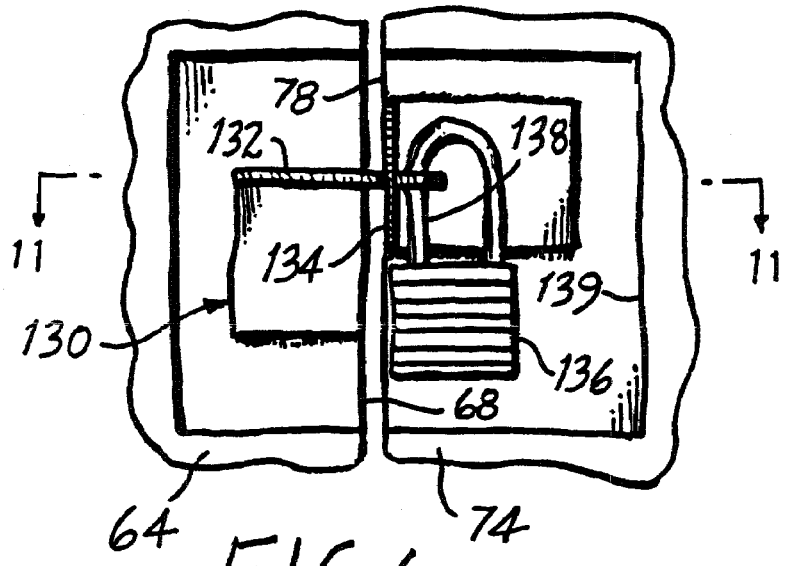
FIG. 6 is an enlarged fragmentary front elevational view of a portion of the cabinet indicated at 6 in FIG. 1.

At the same time, a locking arrangement 130 secures further door panel 64 and still further door panel 74 against lateral movements relative to one another. As best seen in FIG. 6, as well as in FIG. 1, the locking arrangement 130 includes a tongue 132, affixed to the further door panel 64, as by welding, adjacent the far edge 68, the tongue 132 extending through a hasp 134 affixed to the still further door panel 74, as by welding, adjacent the far edge 78, and a padlock 136 engaged with an aperture 138 in the tongue 132 (see also FIG. 11) to secure the tongue 132 against unauthorized release from the hasp 134. The entire locking arrangement 130 is located within a recess 139 in door 42 for presenting a compact, secure configuration.

Figure 7:
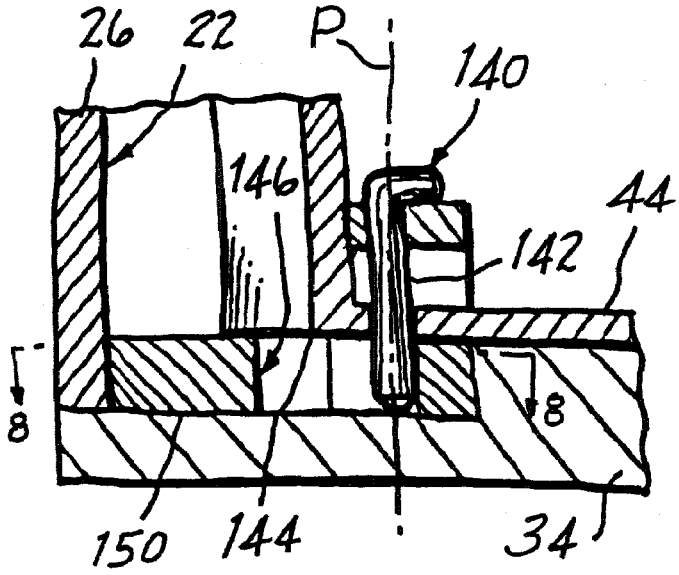
FIG. 7 is an enlarged, fragmentary cross-sectional view of a portion of the cabinet, taken along line 7-7 of FIG. 2.

Selective authorized access to the interior storage space 24 is attained by removing the padlock 136 and then moving the door 42 from the closed position, as illustrated in FIGS. 1 through 5, to an open position of the door 42, wherein the interior storage space 24 is accessed through opening 40. To that end, a coupling arrangement 140 couples the first door panel 44 with the case 22 for selective pivotal movement about a first pivotal axis P extending altitudinally along the first door panel 44, adjacent the near edge 46 of the first door panel 44. The coupling arrangement 140 includes a first lower pivot pin 142 placed in the first door panel 44 adjacent the lower corner 144 of the first door panel 44 to project downwardly, along the pivotal axis P, and engage a first lower groove 146 in a lower guide plate 150 affixed to the basal member 34, as seen in FIG. 7. As depicted diagrammatically in FIG. 8, first lower groove 146 has a first leg 152 extending along a lateral direction 30, and a second leg 154 extending along a transverse direction 38. In the preferred construction, the second leg 154 is essentially perpendicular to and is longer than the first leg 152, so that first lower groove 146 follows an L-shaped configuration, thereby configuring the coupling arrangement 140 for operation as described more fully below.

Figure 8:
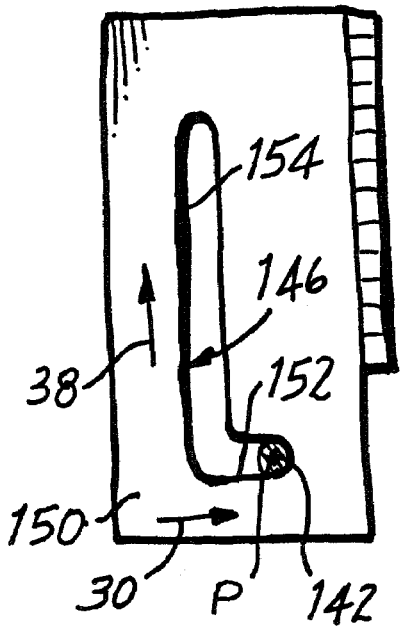
FIG. 8 is a somewhat diagrammatic view taken along line 8-8 of FIG. 7.

As shown in FIG. 3, with additional reference to FIG. 1, a first upper pivot pin 155 is affixed to the first door panel 44 adjacent the upper corner 156 of the first door panel 44 to project upwardly, along the first pivotal axis P, and engage a first upper groove 157 in a first upper guide plate 160 affixed to the top member 36, the first upper guide plate 160 and the first upper groove 157 being a mirror image of the first lower guide plate 150 and the first lower groove 146 depicted diagrammatically in FIG. 8.

In a similar manner, a second lower pivot pin 162 is affixed to the second door panel 54 adjacent the lower corner 164 of the second door panel 54 to project downwardly, along a second pivotal axis PP which extends along the second door panel 54, adjacent the near edge 56, to engage a second lower groove 166 in a second lower guide plate 170 affixed to the basal member 34, as seen in FIG. 2. Second lower groove 166 has a configuration symmetrical to first lower groove 146 and includes a first leg 172 extending along a lateral direction 30, and a second leg 174 extending along a transverse direction 38. As shown in FIG. 3, with additional reference to FIG. 1, a second upper pivot pin 175 is affixed to the second door panel 54 adjacent the upper corner 176 of the second door panel 54 to project upwardly, along the second pivotal axis PP, to engage a second upper groove 177 in a second upper guide plate 180 affixed to the top member 36, the second upper guide plate 180 and the second upper groove 177 being a mirror image of the second lower guide plate 170 and the second lower groove 166.

When the door 42 is closed and locked, the door panels 44, 54, 64 and 74 are located in the common lateral plane 120, each pivot pin is located at a respective end of a lateral leg of a respective groove, as represented by the diagrammatic illustration in FIG. 8 wherein first lower pivot pin 142 is shown in first lower groove 146, the door panels 44, 54, 64 and 74 are aligned along lateral directions 30, the latches 80, 90, 100 and 110 are engaged to secure the respective door panels 44, 54, 64 and 74 in place within common plane 120, as seen in FIGS. 2 and 3, and the tongue 132 extends through hasp 134 for reception of the padlock 136, as seen in FIGS. 1 and 6. The combination of the pivot pins being engaged in the respective lateral legs of the grooves, and the latches being engaged, assures that the door panels 44, 54, 64 and 74 cannot be moved out of the common lateral plane 120.

Figure 9:
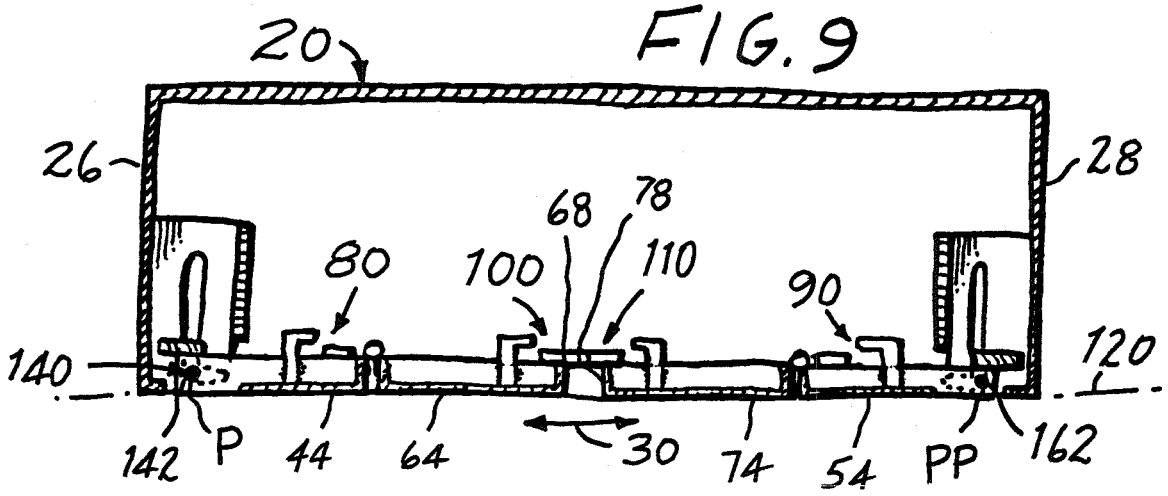
FIG. 9 is a somewhat diagrammatic cross-sectional view similar to FIG. 2, but showing the component parts in another position.
Figure 10:
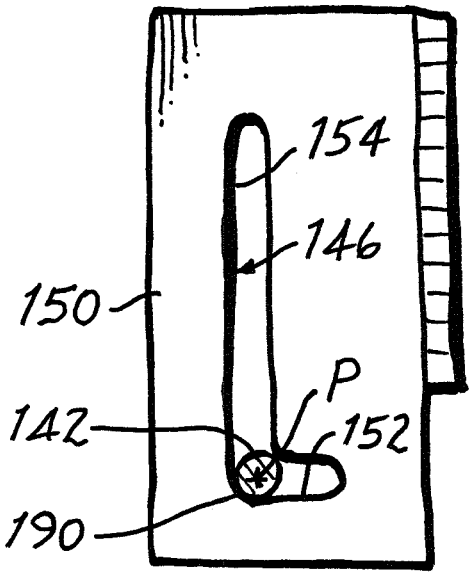
FIG. 10 is a somewhat diagrammatic view similar to FIG. 8, but showing the component in the operating position of FIG. 9.
Figure 11:
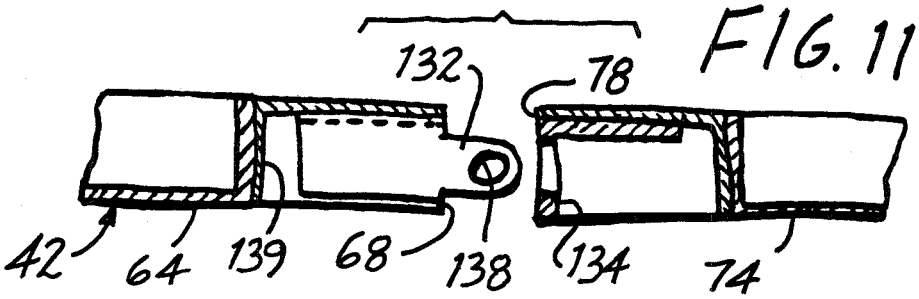
FIG. 11 is a cross-sectional view taken along line 11-11 of FIG. 6, but with component parts in the position shown in FIG. 9.
Figure 12:
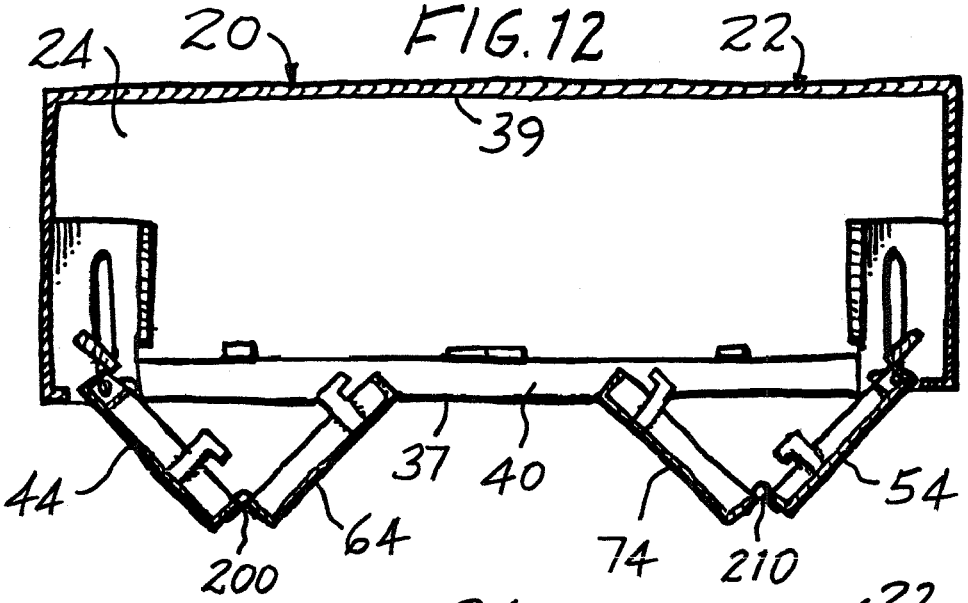
FIG. 12 is a somewhat diagrammatic, cross-sectional view similar to FIG. 2, but showing the component parts in still another operating position.

Upon removal of the padlock 136, door 42 may be opened by first moving further door panel 64 and still further door panel 74 laterally away from one another, with concomitant lateral movement of the first and second door panels 44 and 54, to an unlocked position, as shown in FIG. 9. Such lateral movement along a first path of travel is permitted by translation of the pivot pins laterally within counterpart lateral legs of corresponding grooves, until the pivot pins and, consequently, pivotal axes P and PP, reach an intersection between respective lateral legs, and transverse legs, as depicted diagrammatically in FIG. 10 wherein first lower pivot pin 142 is shown at intersection 190 between lateral leg 152 and transverse leg 154 of first lower groove 146. At the same time, lateral translation of the door panels 44, 54, 64 and 74 along the first path of travel retracts the tongue 132 from the hasp 134, as illustrated in FIG. 11, and disengages the latches 80, 90, 100 and 110, as seen in FIG. 9. Upon each pivot pin reaching a respective intersection, the first door panel 44 can be rotated pivotally about the first pivotal axis P, and the second door panel 54 can be pivotally rotated about the second pivotal axis PP, thereby moving the door panels 44, 54, 64 and 74 toward an intermediate position, as shown in FIG. 12, toward opening the door 42 for gaining access to the interior storage space 24, through opening 40.

In order to maintain a relatively compact configuration, even when the door 42 is open, the further door panel 64 is hinged to the first door panel 44, by a hinge 200 which extends in an altitudinal direction along the far edge 46 of the first door panel 44 and the near edge 66 of further door panel 64, and the still further door panel 74 is hinged to the second door panel 54, by a hinge 210 which extends in an altitudinal direction along the far edge 58 of the second door panel 54 and the near edge 76 of the still further door panel 74. Upon placement of each pivot pin at a corresponding intersection of the legs of a respective upper or lower groove, the first door panel 44 may be pivoted about first pivotal axis P from the previous lateral orientation toward a transverse orientation and the further door panel 64 folded toward juxtaposition with the first door panel 44, as seen in FIG. 12. Likewise, the second door panel 54 can be pivoted about second pivotal axis PP from the previous lateral orientation toward a transverse orientation, and the still further door panel 74 folded toward juxtaposition with the second door panel 54, as seen in FIG. 12. Once fully folded into juxtaposition with one another, first and further door panels 44 and 64 can be moved transversely back, as a unit, as shown in FIG. 13, to slide between the side panel 26 and guides in the form of guide rails 220 carried by guide plates 150 and 160.

Figure 13:
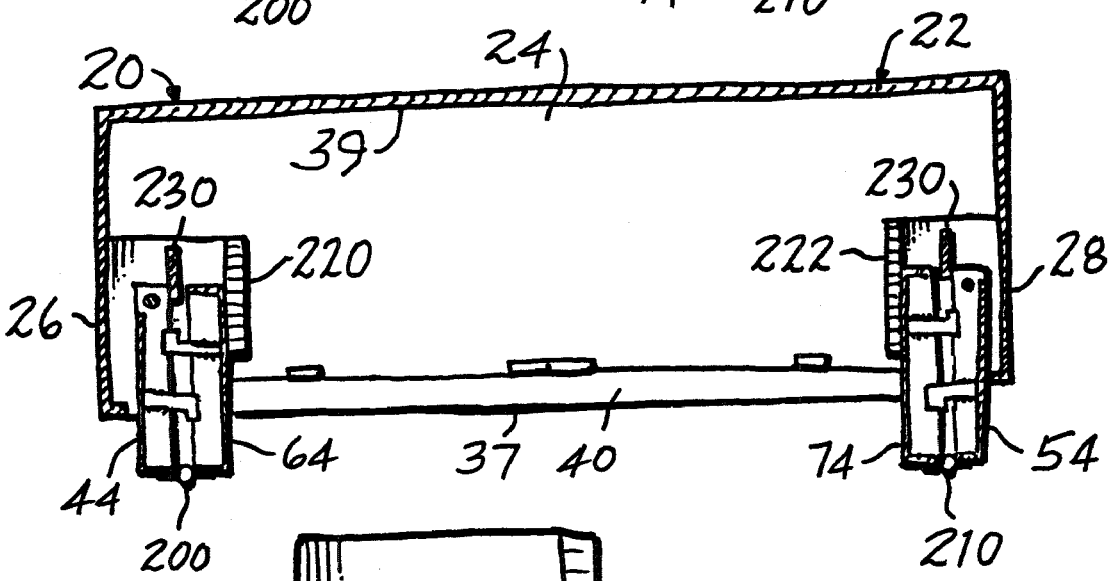
FIG. 13 is a somewhat diagrammatic, cross-sectional view similar to FIG. 2, but showing the component parts in yet another operating position.
Figure 14:
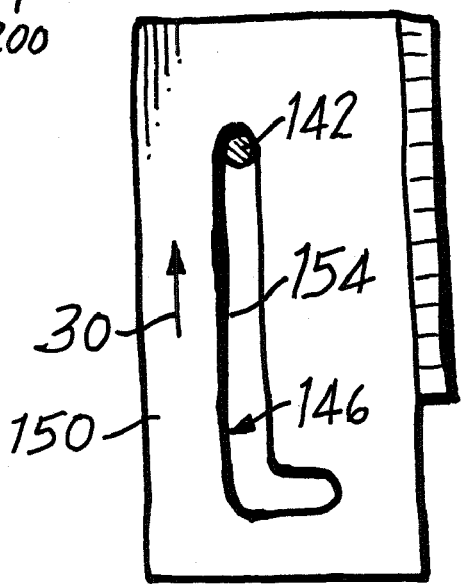
FIG. 14 is a somewhat diagrammatic view similar to FIG. 8, but showing the component parts in the operating position of FIG. 13.

Translation of the first lower and upper pivot pins 142 and 155 along corresponding transverse legs of respective grooves, as exemplified by the diagrammatic illustration in FIG. 14 showing first lower pivot pin 142 in second leg 154 of first lower groove 146, enables the folded first and further door panels 44 and 64 to be moved as a unit into the case 22 along a second path of travel, from the front 37 toward the back panel 39 of the case 22, to establish a compact configuration in the open storage cabinet 20, as illustrated in FIG. 13. Similarly, the fully folded second and still further door panels 54 and 74 may be moved transversely back between side panel 28 and guides in the form of guide rails 222 carried by guide plates 170 and 180, as shown in FIG. 13, translation of the second lower and upper pivot pins 162 and 175 along corresponding transverse legs of respective second lower and upper grooves 166 and 177 enabling the folded second and still further door panels 54 and 74 to be moved as a unit into the case 22, along a path of travel from the front 37 toward the back panel 39 of the case 22, to complete the compact configuration in the open storage cabinet 20, with unobstructed access to the interior storage space 24, through opening 40.

The storage cabinet 20 is closed and locked merely by reversing the above-described opening procedure. That is, the folded first and further door panels 44 and 64 are pulled forward, transversely out of the case 22, until the first pivot pins 142 and 155 reach respective intersections in corresponding grooves 146 and 157. The folded second and still further door panels 54 and 74 are pulled forward, transversely out of the case 22, until the second corresponding grooves 166 and 177. The door panels 44, 54, 64 and 74 then are unfolded and pivoted to be placed in the common lateral plane 120, and then are translated in lateral directions until the further panel 64 and the still further panel 74 are juxtaposed at respective far edges 68 and 78. The lateral translation engages each of the latches 80, 90, 100 and 110 to maintain the door panels 44, 54, 64 and 74 in the common plane 120, and the tongue 132 enters the hasp 134 for reception of the padlock 136. A border strip 230 affixed, as by welding, altitudinally along each near edge 46 and 56 of respective first and second door panels 44 and 54, extends laterally to complete closing of the opening 40 against unauthorized access to the interior storage space 24.

It will be seen that the present invention attains all of the objects and advantages summarized above, namely: Provides a storage cabinet offering a high degree of security for stored items, with ease of authorized access to the stored items; maintains an unobstructed, effective storage space for efficient storage of items which require restricted access; features a compact construction requiring only minimal installation space for maximum storage capacity and enabling ease of placement in a wide variety of locations; enables simple and ready operation for authorized use; provides a rugged construction, economically manufactured for exemplary performance over a long service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A storage cabinet for providing secure storage with ready authorized access to stored items, the storage cabinet comprising:

a case providing an interior storage space, the case including first and second sides spaced apart laterally, extending altitudinally between a base and a top, and extending transversely between a front and a back to bound the interior storage space;

an opening at the front of the case for enabling access to the interior storage space;

a door having at least a first panel extending altitudinally between the base and the top of the case, the first panel having a near edge juxtaposed with the first side of the case;

a coupling arrangement coupling the first panel of the door with the case for selective pivotal movement about a first pivotal axis extending altitudinally along the first panel, adjacent the near edge, between a first orientation wherein the panel extends in a lateral direction along the front of the case, between the first and second sides of the case, and a second orientation wherein the first panel extends in a transverse direction outwardly from the interior storage space; and a latching arrangement for securing the door in place across the opening, the latching arrangement including complementary latching members carried by the case and the door for selective engagement and disengagement in response to corresponding movements of the door in lateral directions relative to the case between a latched location wherein engagement of the latching members precludes movement of the panel out of the first orientation and an unlatched location wherein disengagement of the latching members enables movement of the panel out of the first orientation and into the second orientation;

the coupling arrangement further being configured for enabling lateral translation of the first pivotal axis for selective movement of the first pivotal axis and the first panel along a first path of travel extending laterally across the front of the case to move the door between the latched location and the unlatched location when the panel is in the first orientation and for transverse translation of the first pivotal axis for selective retraction and advancement of the first pivotal axis and the first panel along a second path of travel extending adjacent the first side, between the front and the back of the case, when the panel is in the second orientation.

2. The storage cabinet of claim 1 wherein the coupling arrangement includes a pivot pin engaged within a complementary groove, the groove having a first leg extending in the lateral direction for enabling lateral translation of the pivotal axis, and a second leg extending in the transverse direction for enabling transverse translation of the pivotal axis.

3. The storage cabinet of claim 2 wherein the second leg of the groove extends transversely into the case, alongside the first side of the case, enabling the first panel to be retracted into the case, alongside the first side, upon retraction along the second path of travel.

4. The storage cabinet of claim 3 wherein the second leg of the groove is longer than the first leg of the groove and extends essentially perpendicular to the first leg such that the groove follows an L-shaped configuration.

5. The storage cabinet of claim 3 wherein the first panel includes a far edge spaced laterally from the near edge, and the door includes a further panel hinged to the first panel along the far edge for enabling folding of the further panel into juxtaposition with the first panel when the first panel is in the second orientation.

6. The storage cabinet of claim 5 including a guide for guiding the juxtaposed first and further panels as a unit along the second path of travel upon retraction of the first and further panels into the case.

7. The storage cabinet of claim 6 wherein the second leg of the groove is longer than the first leg of the groove and extends essentially perpendicular to the first leg such that the groove follows an L-shaped configuration.

8. The storage cabinet of claim 5 including further complementary latching members carried by the case and the further panel for selective engagement and disengagement in response to corresponding movements of the further panel in the lateral directions relative to the case between a latched location and an unlatched location.

9. The storage cabinet of claim 1 wherein;

the door includes a second panel extending altitudinally between the base and the top of the case, the second panel having a near edge juxtaposed with the second side of the case;

the coupling arrangement couples the second panel of the door with the case for selective pivotal movement about a second pivotal axis extending altitudinally along the second panel, adjacent the near edge of the second panel, between a first orientation wherein the second panel extends in a lateral direction along the front of the case, between the first and second sides of the case, and a second orientation wherein the second panel extends in a transverse direction outwardly from the interior storage space; and the latching arrangement includes complementary latching members carried by the case and the second panel for selective engagement and disengagement in response to corresponding movements of the second panel in lateral directions relative to the case between a latched location wherein engagement of the latching members precludes movement of the second panel out of the first orientation and an unlatched location wherein disengagement of the latching members enables movement of the second panel out of the first orientation and into the second orientation;

the coupling arrangement further being configured for enabling lateral translation of the second pivotal axis for selective movement of the second pivotal axis and the second panel along a further lateral path of travel extending across the front of the case to move the second panel laterally between the latched location and the unlatched location when the second panel is in the first orientation and for transverse translation of the second pivotal axis for selective retraction and advancement of the second pivotal axis and the second panel along a further transverse path of travel extending adjacent the second side, between the front and the back of the case, when the second panel is in the second orientation.

10. The storage cabinet of claim 9 wherein the coupling arrangement includes a second pivot pin engaged within a complementary second groove, the second groove having a first leg extending in the lateral direction for enabling lateral translation of the second pivotal axis, and a second leg extending in the transverse direction for enabling transverse translation of the second pivotal axis.

11. The storage cabinet of claim 10 wherein the second leg of the second groove extends transversely into the case, alongside the second side of the case, enabling the second panel to be retracted into the case, alongside the second side, upon retraction along the further transverse path of travel established by the second groove.

12. The storage cabinet of claim 11 wherein the second leg of the second groove is longer than the first leg of the second groove and extends essentially perpendicular to the first leg of the second groove such that the second groove follows an L-shaped configuration.

13. The storage cabinet of claim 10 wherein:

the first panel includes a far edge spaced laterally from the near edge of the first panel, the door includes a further panel hinged to the first panel along the far edge for enabling folding of the further panel into juxtaposition with the first panel when the first panel is in the second orientation; and the second panel includes a far edge spaced laterally from the near edge of the second panel, the door includes a still further panel hinged to the second panel along the far edge of the second panel for enabling folding of the still further panel into juxtaposition with the second panel when the second panel is in the second orientation.

14. The storage cabinet of claim 13 including:

a first guide for guiding the juxtaposed first and further panels along the second path of travel upon retraction of the first and further panels into the case; and a second guide for guiding the juxtaposed second panel and still further panel along the further transverse path of travel upon retraction of the second and still further panels into the case.

15. The storage cabinet of claim 14 wherein the second leg of the second groove is longer than the first leg of the second groove and extends essentially perpendicular to the first leg of the second groove such that the second groove follows an L-shaped configuration.

16. The storage cabinet of claim 13 wherein the latching arrangement includes:

further complementary latching members carried by the case and the further panel for selective engagement and disengagement in response to corresponding movements of the further panel in the lateral directions relative to the case between a latched location wherein engagement of the latching members precludes movement of the further panel out of the first orientation and an unlatched location wherein disengagement of the latching members enables movement of the further panel out of the first orientation and into the second orientation; and still further complementary latching members carried by the case and the still further panel for selective engagement and disengagement in response to corresponding movements of the still further panel in the lateral directions relative to the case between a latched location wherein engagement of the latching members precludes movement of the still further panel out of the first orientation and an unlatched location wherein disengagement of the latching members enables movement of the still further panel out of the first orientation and into the second orientation.

17. The storage cabinet of claim 16 including a locking arrangement on the further panel and on the still further panel for selectively locking together the further panel and the still further panel against unauthorized lateral movements when the further panel and the still further panel each are in the first orientation and are in respective latched locations.

* * * * *